US007236163B2

(12) United States Patent
Yoo

(10) Patent No.: US 7,236,163 B2
(45) Date of Patent: Jun. 26, 2007

(54) APPARATUS FOR ADJUSTING SAMPLING PHASE OF DIGITAL DISPLAY AND ADJUSTMENT METHOD THEREOF

(75) Inventor: Tae-kwon Yoo, Suwon (KR)

(73) Assignee: Samsung Electronics Co., Ltd., Gyunggi-do (KR)

( * ) Notice: Subject to any disclaimer, the term of this patent is extended or adjusted under 35 U.S.C. 154(b) by 497 days.

(21) Appl. No.: 10/700,627

(22) Filed: Nov. 5, 2003

(65) Prior Publication Data

US 2004/0090413 A1 May 13, 2004

(30) Foreign Application Priority Data

Nov. 12, 2002 (KR) ..... 10-2002-0070123

(51) Int. Cl.
*G09G 5/00* (2006.01)

(52) U.S. Cl. ..... 345/213; 345/204

(58) Field of Classification Search ..... 345/87, 345/98, 99–100, 204, 211, 212–214; 327/39, 327/47, 48–49; 348/536–541
See application file for complete search history.

(56) References Cited

U.S. PATENT DOCUMENTS 5,940,136 A * 8/1999 Abe et al. ..... 348/537
6,160,542 A * 12/2000 Hwang ..... 345/213
6,326,961 B1 * 12/2001 Lin et al. ..... 345/213
6,337,682 B1 * 1/2002 Hwang ..... 345/213
6,404,422 B1 * 6/2002 Choi ..... 345/211
6,459,426 B1 * 10/2002 Eglit et al. ..... 345/213
6,597,370 B1 * 7/2003 Lee ..... 345/660
6,856,358 B1 * 2/2005 Wang ..... 348/537

FOREIGN PATENT DOCUMENTS

CN 1168065 A 12/1997

OTHER PUBLICATIONS

Chinese Office Action issued May 19, 2006 with respect to Chinese Patent Application No. 200310114807.X filed on Nov. 7, 2003.

* cited by examiner

*Primary Examiner*—Richard Hjerpe
*Assistant Examiner*—Mansour M. Said
(74) *Attorney, Agent, or Firm*—Sughrue Mion, PLLC

(57) ABSTRACT

An apparatus for adjusting a sampling phase in analog to digital conversion, and an adjustment method thereof is disclosed. Provided are an apparatus for adjusting a sampling phase of a digital display including a phase locked loop (PLL) circuit unit for converting a frequency of a sampling clock signal and outputting the converted frequency, the sampling clock signal for converting an analog video signal into digital format, an analog to digital converter (ADC) for converting the incoming analog video signal into digital format using the sampling clock signal input from the PLL circuit unit, a detection unit for detecting a maximum phase shift of the video signal converted at the ADC, and a control unit for controlling the PLL circuit unit so that the sampling phase can be adjusted in accordance with the maximum phase shift detected by the detection unit, and an adjustment method of the apparatus.

11 Claims, 4 Drawing Sheets

APPARATUS FOR ADJUSTING SAMPLING PHASE OF DIGITAL DISPLAY AND ADJUSTMENT METHOD THEREOF

This application claims the priority of Korean Patent Application No. 2002-0070123, filed on Nov. 12, 2002, in the Korean Intellectual Property Office, the disclosure of which is incorporated herein in its entirety by reference.

BACKGROUND OF THE INVENTION

1. Field of the Invention

The present invention relates to an apparatus for adjusting a sampling phase of a digital display and an adjustment method thereof, and more particularly, to an apparatus for adjusting a sampling phase of a digital display in accordance with the number of occurrence of phase shift of video signal during a conversion from analog video signal to digital format, and an adjustment method thereof.

2. Description of the Prior Art

As flat panel display (FPD) such as liquid crystal display (LCD) is in great demand, there are also increasing demands for image processing apparatuses that convert incoming analog video signal into digital format to adaptively use it for display.

For a conversion of analog signal into digital format, a clock signal is generated, and if the phase of the generated clock signal does not correspond with the signal source, image quality deteriorates. Accordingly, the phase of the sampling clock signals needs to be adjusted whenever there occurs a change in signal source.

As an existing method for adjusting the phase of the sampling clock signal, there is a method that adjusts the phase of the sampling clock signal based on a difference of horizontal resolution of pixel data and digital signal.

The sampling phase adjustment apparatus employing the above existing adjustment method is provided with an input level interface into which analog video signal is inputted, an A/D converter for converting incoming analog video signal into digital format, a phase locked loop (PLL) circuit that generates and supplies sampling clock to the A/D converter, a data latch/logic unit that detects number of pixels in an active region where effective video signals exist, and a control unit that controls the PLL by converting the PLL data in accordance with the incoming video signal and the horizontal synchronization signal, and a synchronization signal processing unit that generates information about incoming signal in accordance with the horizontal and the vertical synchronization signals and supplies the generated information to the control unit.

FIG. 1 is a flowchart for illustrating a method for adjusting a sampling clock by detecting number of pixels in the active region with a sampling phase adjusting apparatus.

As shown in FIG. 1, the control unit determines a resolution mode of the incoming video signal in accordance with the horizontal and vertical synchronization signal of the incoming analog video signal in operation S1. Here, the incoming analog video signal is the signal that has been processed at the synchronization signal processing unit. As the resolution mode of the incoming video signal is determined, the control unit sets the PLL by supplying the PLL data corresponding to the resolution mode to the PLL circuit, and thus, the PLL circuit generates a sampling clock at a basic sampling frequency in operation S2. After the A/D conversion at the sampling clock, the data latch/logic unit detects number of pixels in the active region in operation S3. Then through the comparison of the detected number of pixels and reference number of pixels in operation S4, the control unit adjusts the sampling phase to an optimum in accordance with the number of pixels of the active region in operation S5 when the absolute value of the difference equals 1. When the absolute value of the difference is other than '1' in operation S4, operations in S2 and S3 are repeated. After the adjustment of the sampling phase through the operation in S5, the control unit determines whether the detected number of pixels of the active region equals the reference number of pixels in operation S6, and if so, adjusts the horizontal position in accordance with the detected number of pixels of the active region in operation S7. When it is determined that the detected number of pixels of the active region is different from the reference number of pixels in operation S6, the control unit returns to the operation of S2 and re-adjusts the sampling phase.

The above existing method, which adjusts the position of the sampling clock based on the difference between the number of pixels in the active region and the reference number of pixels, have several limitations as follows. That is, the existing method requires computations that are too complex for the capacity of a general microcomputer provided in the digital display to handle. If the resolution of the digital display is increased, it takes a considerable time for the computation, while, if the width of the detected data is reduced to shorten the time for procedures, optimum sampling phase is hardly found.

Meanwhile, there is another method presently available for adjusting the sampling phase. According to this method, whether the beginning and last active data exist in the active video pixel or not is determined based on the horizontal synchronization signal, and the active regions are compared, and if they are correct, optimum sampling phase is determined using the phases of the both active data. However, this method accompanies a problem. That is, if there is no clear difference between the beginning and the last active data as in the case of one dot on/off pattern, while there is no beginning, or last active data in the horizontal direction, or if the phase of the active data is mistakenly determined due to external factors such as noise, error occurs in video data region determination. In brief, the method of determining the median of the beginning and the last phases as an optimum phase is quite prone to errors.

SUMMARY OF THE INVENTION

Accordingly, it is an aspect of the present invention to provide an apparatus for adjusting a sampling phase of a digital display, which is capable of adjusting sampling clock phase without an error, even with a microcomputer of low capacity, when the resolution of the digital display is increased.

In order to accomplish the above aspects and/or features of the present invention, an apparatus for adjusting a sampling phase of a digital display includes a phase locked loop (PLL) circuit unit for converting a frequency of a sampling clock signal and outputting the converted frequency, the sampling clock signal for converting an analog video signal into digital format, an analog to digital converter (ADC) for converting the incoming analog video signal into digital format using the sampling clock signal input from the PLL circuit unit, a detection unit for detecting in a predetermined region a maximum phase shift of the video signal converted at the ADC, and a control unit for controlling the PLL circuit unit so that the sampling phase can be adjusted in accordance with the maximum phase shift detected by the detection unit.

The detection unit detects the number of phase shifts exceeding a predetermined reference level within the predetermined region, and when determining the number of phase shifts to be equal to, or greater than a predetermined value, detecting a maximum phase shift in the predetermined region.

The detection unit includes a comparator that detects whether the video signal is varied at, or above the predetermined reference level based on the comparison between the input video signal from the ADC and the reference level, a counter that detects the maximum phase shift by counting the output signal from the comparator, and a reference setting unit that inputs the predetermined reference level to the comparator for the comparison with the video signal.

Upon determining that the number of phase shifts exceeding the predetermined reference level is within the predetermined value, the control unit controls the detection unit to detect the phase shift in another detection region.

Meanwhile, the detection unit adjusts a sampling phase by computing one of 50% and 75% phases of entire checking region with respect to the maximum phase shift in accordance with characteristic of the incoming video signal.

According to the present invention, a method for adjusting a sampling phase of a digital display includes the steps of converting an incoming video signal in a predetermined region into a digital format, and analyzing the converted signal, determining whether a phase shift in which the signal analyzed in the previous varies at or above a predetermined level, occurs more frequent than a predetermined value, if determining that the phase shift occurred more frequently than the predetermined value, detecting a maximum phase shift of the predetermined region, and adjusting the sampling phase in accordance with the phase detected in the previous step.

In case it is determined in the step of determining the number of phase shifts that the phase shifts have occurred less frequently than the predetermined value, the step of changing the phase shift detection region, and returning to the signal analyzing step is included in an exemplary embodiment.

After completion of the automatic sampling clock within the predetermined region, detecting in the above detecting step for a maximum phase shift of the input signal while moving phase of pixel is included in an exemplary embodiment.

In the adjusting step, a sampling phase adjustment is made by computing one of 50% and 75% phases of entire checking region, or the phase shift detection region, with respect to the maximum phase shift in accordance with characteristic of the incoming video signal.

BRIEF DESCRIPTION OF THE DRAWINGS

The above objects and other features of the present invention will become more apparent by describing in detail an exemplary embodiment thereof with reference to the attached drawings, in which.

DETAILED DESCRIPTION OF THE EXEMPLARY EMBODIMENT

Hereinafter, the present invention will be described in detail with reference to the accompanying drawings.

Figure 3:
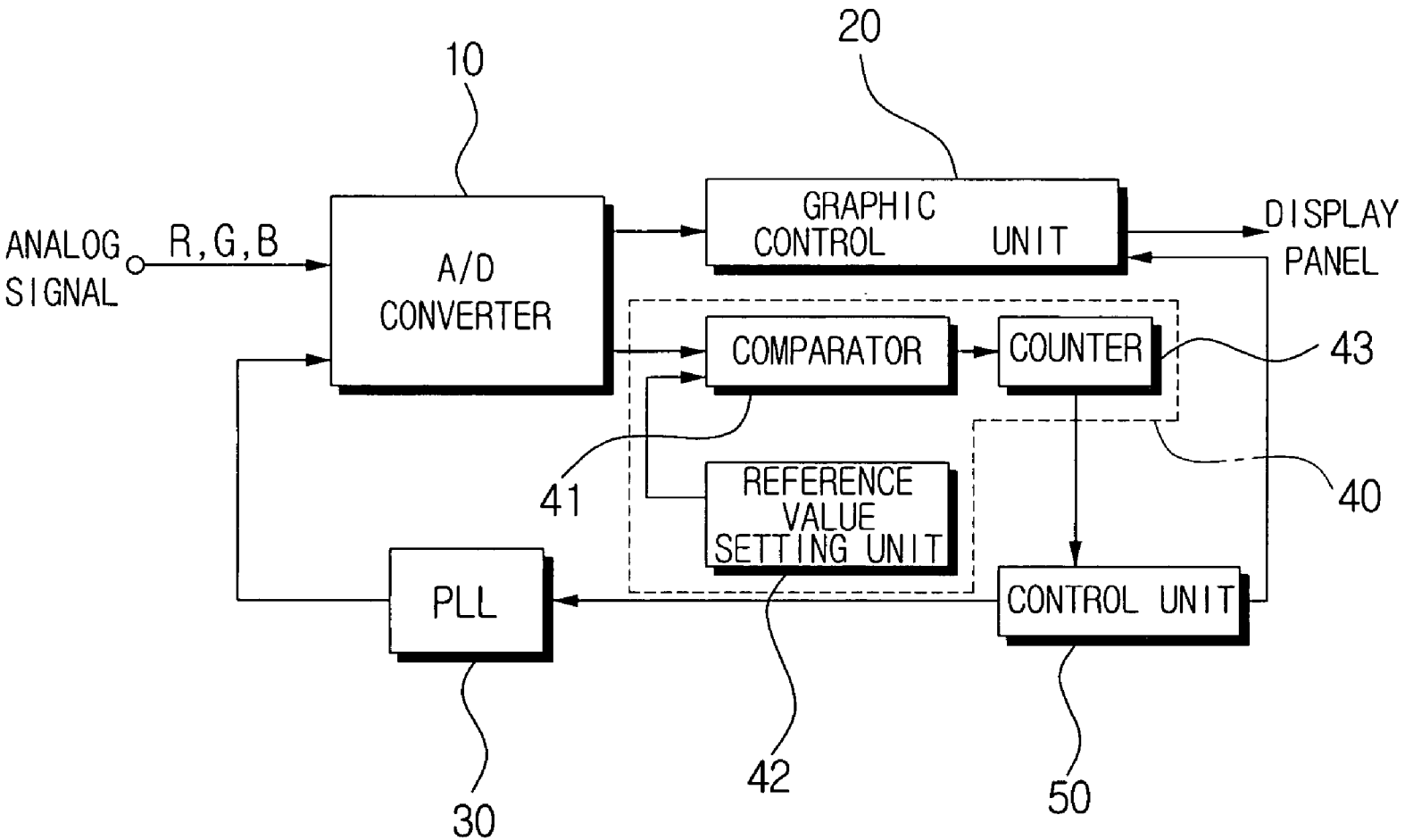
FIG. 3 is a schematic block diagram of an apparatus for adjusting sampling phase according to the present invention.

FIG. 3 is a block diagram of an apparatus for adjusting a sampling phase of a digital display according to the present invention.

As shown in FIG. 3, the digital display includes an analog to digital converter (ADC) 10 to which analog video signal is applied, a graphic control unit 20 connected with the ADC 10, a phase lock look (PLL) circuit unit 30 to apply the sampling clock signal to the ADC 10 in connection thereto, a detecting unit 40 having a comparator 41, a counter 43, and a reference value setting unit 42, and a control unit 50 for controlling the entire system.

The PLL circuit unit 30 adjusts phase and frequency of the sampling clock signal in accordance with the control signal input from the control unit 50, and then applies the adjusted phase and frequency to the ADC 10. The ADC 10 converts the incoming analog video signal into digital format in accordance with the sampling clock signal being input from the PLL circuit unit 30. The graphic control unit 20 scales the converted digital signal from the ADC 10 in accordance with the control signal being input from the control unit 50, and displays image signal on a display panel.

The detection unit 40, being provided with the comparator 41 that compares the converted video signal from the ADC 10 with a reference value, the counter 43 that counts the output signal from the comparator 41, and the reference value setting unit 42 that applies the comparator 41 with a reference value, detects the phase shift of the video signal.

The comparator 41 compares the converted video signal from the ADC 10 with the reference value, thereby detecting the degree of phase shift of the video signal. Accordingly, the degree of phase shift is detected in accordance with the output signal from the comparator 41. As for the reference value of the phase shift, the reference value may be set in the reference value setting unit 42 during a manufacture of the display, or manually set by a user. The output value of the comparator 41 is input to the counter 43. The counter 43 counts the output signal from the comparator 41 and thereby determines the maximum phase shift, and detects the number of phase shifts that exceeds a predetermined level.

During initialization, the control unit 50 applies a control signal to the PLL circuit unit 30 in accordance with the horizontal synchronization signal of the video signal so that the auto-clocking can be performed as the sampling clock signal is output, while the control unit 50 applies a control signal to the PLL circuit unit 30 in accordance with the phase shift detection signal output from the detection unit 40 so as to control the entire system by setting the phase and frequency of the sampling clock signal, adjusting the phase, and recognizing the resolution of the display panel.

Figure 4:
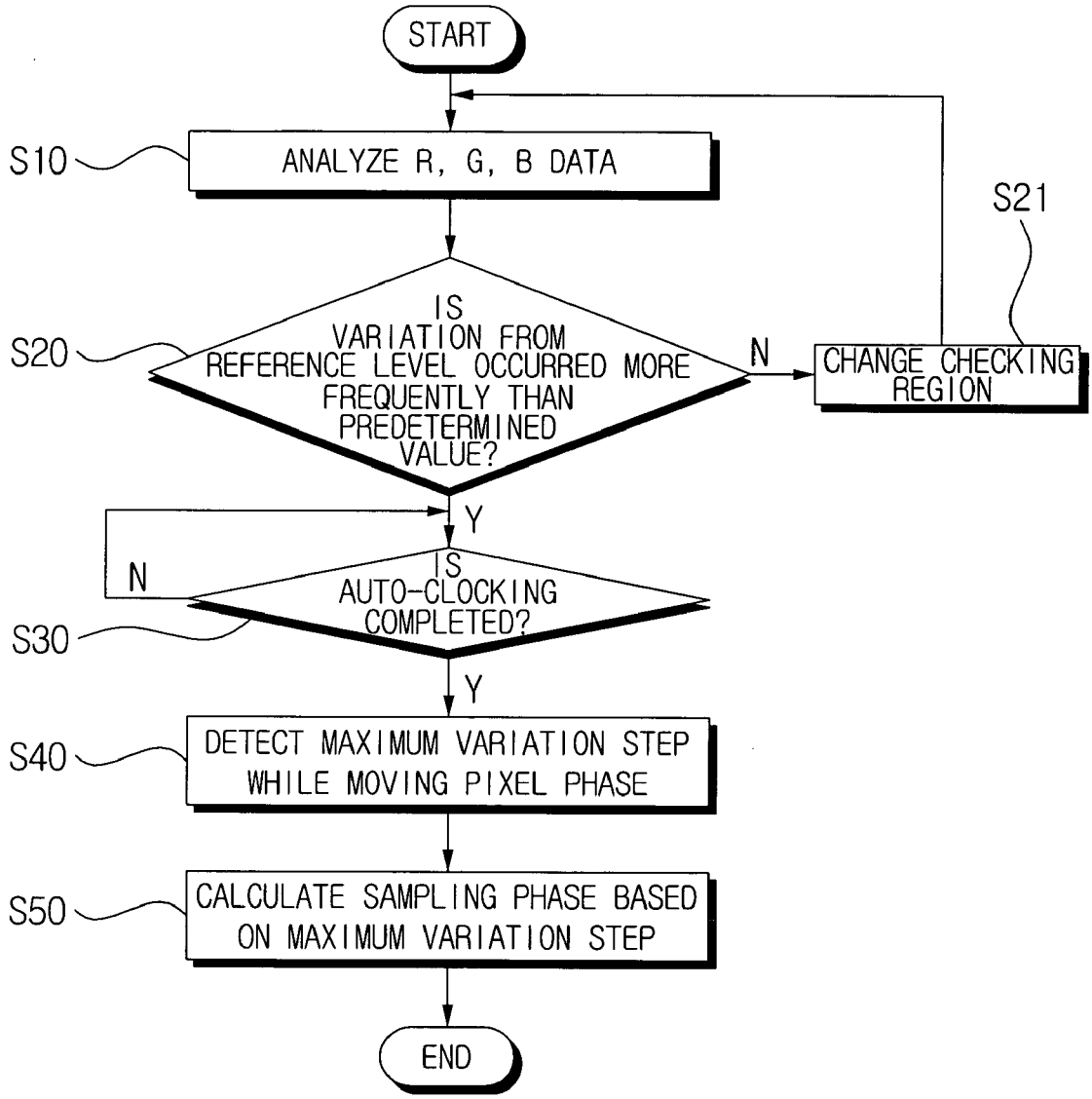
FIG. 4 is a flowchart illustrating an adjusting method of the sampling phase adjusting apparatus of FIG. 3.

The adjustment method of the sampling phase adjusting apparatus of the digital display constructed as above according to the present invention will be described with reference to FIG. 4.

The control unit 50 recognizes the resolution of the current video mode based on the horizontal synchronization signal as input. Then the control unit 50 outputs a control signal to the ADC 10 and the graphic control unit 20 to control the entire system based on the resolution as recognized. If there has been a change in the source of the incoming analog video signal, since the analog video signal and the sampling clock phases input from the PLL circuit unit 30 to the ADC 10 do not correspond to each other, the control unit 50 analyzes in operation S10 the RGB video signal of a predetermined region among the video signals from the ADC 10 in order to adjust the sampling clock phase.

The comparator 41 is input with the video signal from the ADC 10 and determines whether there has been a variation from the reference value from the reference value setting unit 42. By setting the reference value, noise factors can be avoided, while the more accurate phase shift data can be obtained. Output signal from the comparator 41 is applied to the counter 43. By counting, the counter 43 determines whether the number of phase shifts above the reference level exceeds a predetermined number in operation S20. If the number of counted phase shifts in the detection region is lower than the predetermined number, the data is re-detected in different detection region in operation S21. When phase shift above the reference level occurs and the auto-clocking is completed with respect to the detection region in operation S30, the maximum phase shift is detected in operation S40 based on the output signal from the comparator 41 which is counted by the counter 43. Upon detection of the maximum phase shift, reference sampling phase is computed with reference to the detected maximum phase shift in operation S50.

Figure 1:
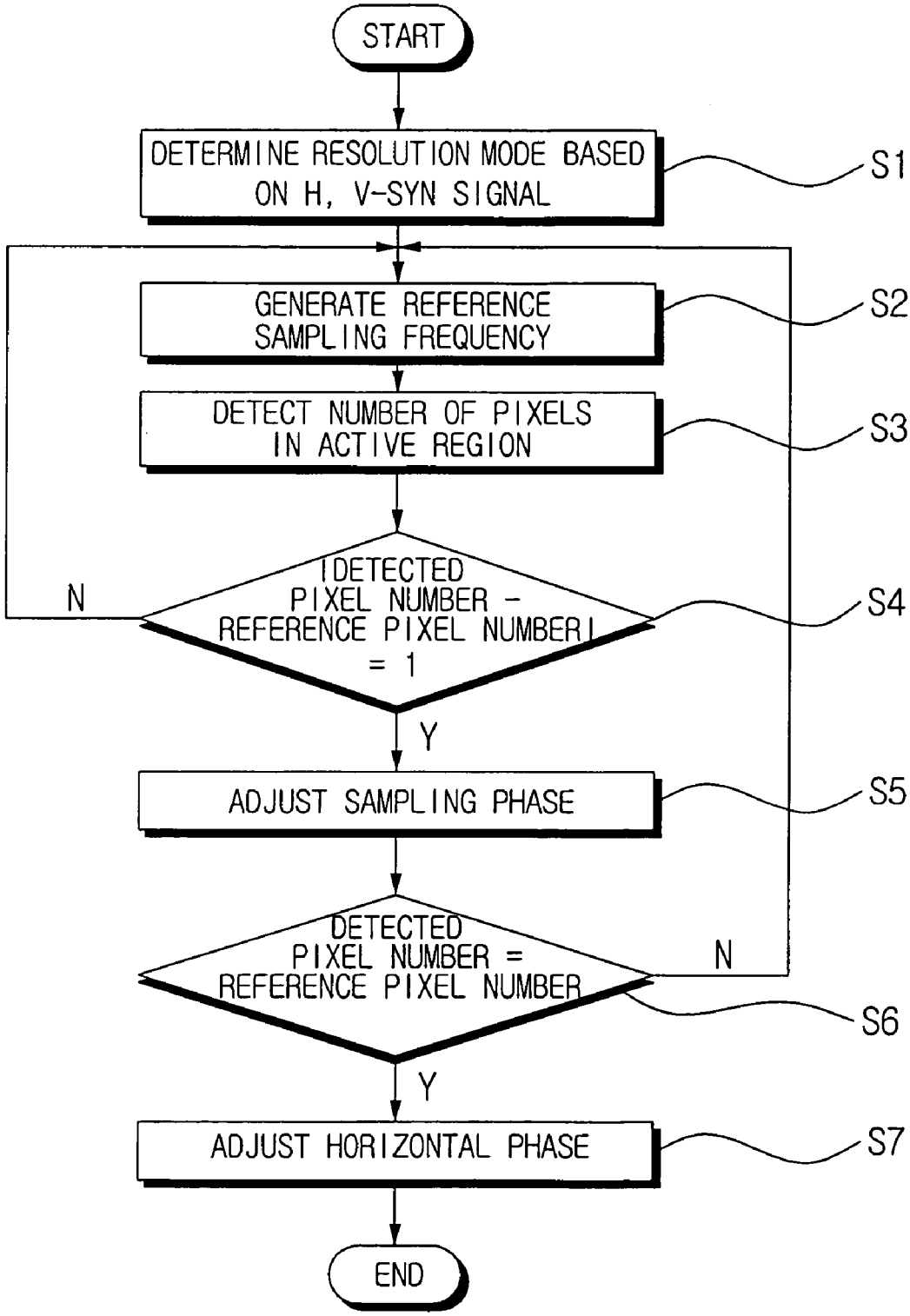
FIG. 1 (PRIOR ART)
FIG. 1 is a flowchart for illustrating the conventional process of adjusting a sampling clock phase.
Figure 2:
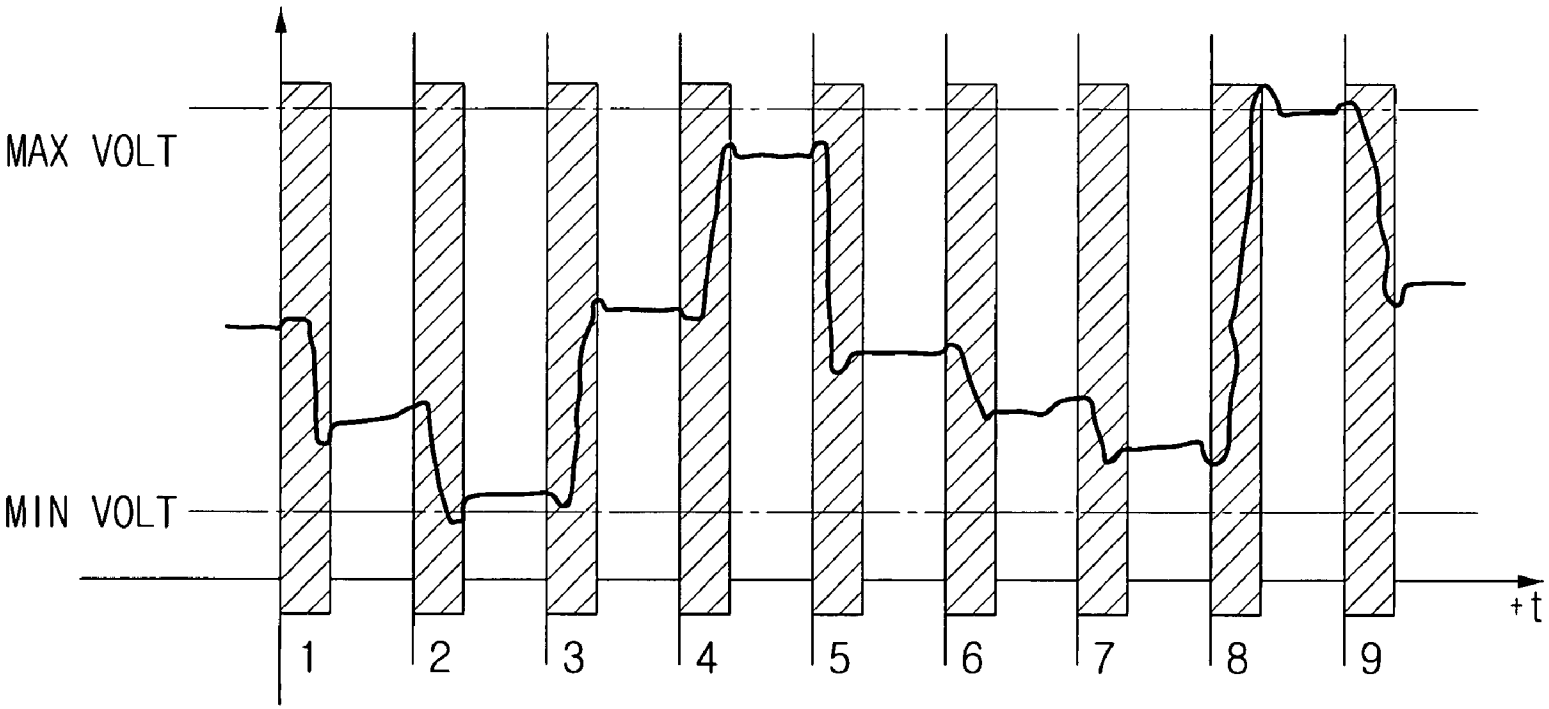
FIG. 2 is a graph illustrating a phase shift and a sampling clock of analog video signal according to the present invention.

Meanwhile, FIG. 2 is a graph showing the video signal and auto clocking with respect to the video signal. The solid line of FIG. 2 represents the video signal, while hatched bars represent pixel clocking.

Continuous analog signal data has phase shift regions as shown in FIG. 2. In the case of phase shift in simple pattern, there is a small phase shift region, while in the case of phase shift in one dot on/off pattern, there are a plurality of phase shift regions existing. Among the phase shift regions, the third clocking and the fourth clocking of FIG. 2 represent positive phase shift regions, and the fifth clocking represents negative phase shift region.

Based on a reference level value, whether the variation occurs or not is determined. The reference level value may be a threshold value that corresponds to the variation of next pixel following the current pixel. The reference level value may be a difference between 8-bit digital data which are converted from the analog signal. For example, in the case that the full range of 700 mV of video signal data are sampled to 8-bit 256 gradations, the threshold value may be 54 mV, and the reference level value of 14 hex may be set for the digital program.

By setting the reference level value as described above, noise factors can be avoided, and more accurate phase shift data can be obtained.

The computation of the reference sampling phase will be described below with reference to FIG. 2.

As shown in FIG. 2, the eighth clocking is the maximum phase shift region. The optimum sampling phase may be determined based on the entire clocking to be 50% or 75% phase for example. In the case that the entire clocking is 32 clocking, since the 8th clocking is the maximum, 50% phase can be the optimum phase, and thus, 8 plus 16, i.e., 24th clocking can be the optimum sampling phase.

The above region check need not be performed over the entire frame, but on several randomly chosen regions. This is because the variation of the regions moves at the same pace, and thus it is not preferable to check the entire frame. Instead, in an exemplary embodiment, even a small piece of region is set that has phase shift exceeding a predetermined value.

Accordingly, it is most important for the sampling phase setting for automatic phase adjustment that the user checks and sees whether there occurs a phase shift exceeding the user's set value. If it is determined that there is no phase shift exceeding the user's set value, the checking is performed on the another region.

According to the present invention, a microcomputer of relatively low capacity can be employed in a high resolution digital display, without an error but with an accuracy in sampling phase setting.

Although a few exemplary embodiments of the present invention has been described, it will be understood by those skilled in the art that the present invention should not be limited to the described exemplary embodiments, but various changes and modifications can be made within the spirit and scope of the present invention as defined by the appended claims.

What is claimed is:

1. An apparatus for adjusting a sampling phase of a digital display, comprising:

a phase locked loop (PLL) circuit unit for converting a frequency of a sampling clock signal and outputting a converted frequency, the sampling clock signal for converting an analog video signal into digital format;

an analog to digital converter (ADC) for converting an incoming analog video signal into digital format using the sampling clock signal input from the PLL circuit unit to output a converted video signal;

a detection unit for detecting in a predetermined region a maximum phase shift of the converted video signal; and a control unit for controlling the PLL circuit unit so that the sampling phase can be adjusted in accordance with the maximum phase shift detected by the detection unit.

2. The apparatus of claim 1, wherein the detection unit detects a number of phase shifts exceeding a predetermined reference level within the predetermined region, and when determining the number of phase shifts to be equal to, or greater than a predetermined value, detecting the maximum phase shift in the predetermined region.

3. The apparatus of claim 1, wherein the detection unit comprises:

a comparator that detects whether the converted video signal is varied to, or above a predetermined reference level based on the comparison between the converted video signal from the ADC and the reference level;

a counter that detects the maximum phase shift by counting an output signal from the comparator; and a reference setting unit that inputs the predetermined reference level to the comparator for the comparison with the converted video signal.

4. The apparatus of claim 1, wherein the control unit, controls the detection unit to detect the maximum phase shift in another detection region based on a signal output from the detection unit indicating that the number of phase shifts exceeding the predetermined reference level is below the predetermined value.

5. The apparatus of claim 1, wherein the detection unit adjusts the sampling phase by computing one of 50% and 75% phases of entire checking region with respect to the maximum phase shift in accordance with a characteristic of the converted video signal.

6. A method for adjusting a sampling phase of a digital display, comprising the steps of:

a) converting an incoming video signal in a predetermined region into a digital format to output a converted video signal, and analyzing the converted signal;

b) determining whether a phase shift in the converted video signal analyzed in step a) varies at or above a predetermined level, and occurs more frequently than a predetermined value;

c) if the phase shift is determined to have occurred more frequently than the predetermined value, detecting a maximum phase shift of the predetermined region; and d) adjusting the sampling phase in accordance with the maximum phase shift detected in step c).

7. The method of claim 6, wherein, if the phase shift exceeding the predetermined reference level is determined to have occurred less frequently than the predetermined value, changing a phase shift detection region, and returning to the step a).

8. The method of claim 6, wherein, after completion of the automatic sampling clock within the predetermined region, the step c) detects a maximum phase shift of the input signal while moving phase of pixel.

9. The method of claim 6, wherein the step d) adjusts the sampling phase by computing one of 50% and 75% phases of entire checking region with respect to the maximum phase shift in accordance with a characteristic of the converted video signal.

10. The apparatus of claim 1, wherein the detection unit receives the converted video signal from the ADC.

11. The apparatus of claim 1, wherein the predetermined region is a region in the converted video signal.

* * * * *